United States Patent [19]

Schaffer et al.

[11] Patent Number: 4,804,517

[45] Date of Patent: Feb. 14, 1989

[54] GOLD COLORED PALLADIUM - INDIUM ALLOYS

[75] Inventors: Stephen P. Schaffer, Hamburg; Clyde E. Ingersoll, Tonawanda, both of N.Y.

[73] Assignee: Williams Dental Company, Inc., Buffalo, N.Y.

[21] Appl. No.: 41,221

[22] Filed: Apr. 22, 1987

Related U.S. Application Data

[63] Continuation-in-part of Ser. No. 837,043, Mar. 6, 1986, abandoned.

[51] Int. Cl.[4] ..... C22C 30/02; C22C 30/00

[52] U.S. Cl. ..... 420/587; 420/580; 420/589; 433/207

[58] Field of Search ..... 420/463, 464, 465, 580, 420/587, 589; 433/207

[56] References Cited

U.S. PATENT DOCUMENTS

| | | | |
|---|---|---|---|
| 2,157,933 | 5/1939 | Hensel et al. | 420/501 |
| 3,667,936 | 6/1972 | Katz | 420/580 |
| 3,819,366 | 6/1974 | Katz | 420/463 |
| 3,929,475 | 12/1975 | Ingersoll | 420/505 |
| 3,989,515 | 11/1976 | Reiff | 420/464 |
| 4,063,937 | 12/1977 | Alexeevich Goltsov et al. | 420/463 |
| 4,149,883 | 4/1979 | Harmsen et al. | 420/464 |
| 4,179,286 | 12/1979 | Knosp | 420/463 |
| 4,261,744 | 4/1981 | Boyajian | 420/463 |
| 4,319,877 | 3/1982 | Boyajian | 420/463 |
| 4,336,290 | 6/1982 | Tsai | 420/463 |
| 4,387,072 | 6/1983 | Schaffer | 420/463 |
| 4,576,790 | 3/1986 | Rothaut et al. | 420/464 |

FOREIGN PATENT DOCUMENTS

| | | | |
|---|---|---|---|
| 3304598 | 8/1984 | Fed. Rep. of Germany | 420/463 |
| 210132 | 12/1983 | Japan | 240/580 |
| 118837 | 7/1984 | Japan | 420/580 |
| 2106137 | 4/1983 | United Kingdom | 420/580 |

*Primary Examiner*—Melvyn J. Andrews
*Assistant Examiner*—Robert L. McDowell
*Attorney, Agent, or Firm*—Christel, Bean & Linihan

[57] ABSTRACT

A yellow dental alloy containing a colored intermetallic compound of palladium and indium as 15–85% by weight of the alloy and at least 10% by weight of silver and as desired gold 0–30%, copper 0–45% and silver 10–50%. This alloy exhibits a pale yellow gold color which it derives from the interaction of two white colored metals—palladium and indium. Various alloying additions are specified to improve castability, ductility, strength, hardness, tarnish and corrosion resistance.

13 Claims, No Drawings

GOLD COLORED PALLADIUM - INDIUM ALLOYS

CROSS-REFERENCE TO RELATED APPLICATIONS

This application is a continuation-in-part of application Ser. No. 837,043 filed Mar. 6, 1986 abandoned.

TECHNICAL FIELD

This invention relates to a new alloy composition which possesses an aesthetically pleasing yellow color, but does not rely on gold and/or copper for its yellow hue. In addition, the alloys according to the present invention possess suitable tarnish and corrosion resistance, as well as sufficient strength and castability, to enable them to be used in dental and/or jewelry applications. It should be noted that pure gold has a reddish yellow color whereas it is usually called yellow. In this specification, yellow and gold color may be used interchangeably.

BACKGROUND

Gold and gold alloys have been used for centuries for dental restorations and jewelry, but the price of gold in today's market imposes economic constraints on the continued use of these materials. Until this invention, the two known ways of obtaining a gold color in an alloy involved the use of sufficient gold or copper to provide the color, these being the only metallic elements which have a yellow to red color.

The traditional yellow alloys for dental restorations and jewelry have been gold-copper-silver with greater use of silver in dental alloys. Copper tends to enhance the gold color unless used in excess, when it enhances the red. Silver enhances the yellow, with excess enhancing a greenish hue. Copper base alloys, notably beta brass and aluminum bronze, have been able to reproduce the color of gold alloys, but have not overcome the tarnish and corrosion susceptibility of copper.

The American National Standards Institute (ANSI), through its Accredited Standards Committee (ASC) MD156, which is sponsored by the American Dental Association (ADA), has developed ANSI/ADA Specification No. 5 which addresses the mechanical properties required for alloys for dental restorations. ANSI/ADA Specification No. 5 for many years has included four types of casting alloys in common use in dentistry. Type I, for restorations subject to very slight stress such as some inlays, having 0.2% offset yield strength (0.2%YS) of up to 140 MPa (20,000 psi); Type II, for restorations subject to moderate stress, such as inlays and onlays, having a 0.2%YS between 140 MPa and 200 MPa (29,000 psi); Type III, for restorations subject to high stress, such as onlays, crowns, thick vaneer crowns and short-span fixed partial dentures, having a 0.2%YS between 200 MPa and 340 MPa (49,000 psi); and Type IV, for restorations thin in cross section and subject to very high stress, such as thin veneer crowns, long-span fixed partial dentures and removable partial dentures, having a 0.2%YS of at least 340 MPa, and hardenable to at least 500 MPa (72,000 psi). Types III and IV are of greater significance here. These are the ones that are most frequently used in today's dentistry. Although the strength of Type III alloys is greater than required for Types I and II applications, it is usually used for these application to avoid the necessity of stocking additional alloys.

This invention employs the term dental alloy within the context of the above-described standards, and it should be understood that any dental alloy of this invention will meet at least the strength and hardness requirements of ANSI/ADA Specification No. 5 for Type II, and almost always for Type III as well.

Many dental alloys have been developed by the instant inventors and others to reduce alloy intrinsic cost, but all such alloys possessed certain disadvantages. If gold was eliminated or substantially reduced without the addition of copper to produce the gold color, the alloy was gray (usually called white). If the copper was increased enough to maintain the color in the absence of gold, the alloy lost its corrosion and/or tarnish resistance. In some instances, in addition to losing color the alloys were not strong enough to perform the required function as indicated in ANSI/ADA No. 5.

In recent years the acceptance of "white" alloys has increased. However, there still remains a significant need within the dental and jewelry industries for a gold colored alloy which is economical to produce and which complies with the ANSI/ADA standards set forth above.

DISCLOSURE OF INVENTION

It is an object of the invention to provide a new and improved alloy composition for dental/jewelry applications and the like.

Another object of the invention is to provide a dental alloy composition which exhibits an aesthetically pleasing yellow color varying from pale yellow to gold to pinkish gold.

Another object of the invention is to provide yellow alloys which may be cast into the intricate shapes required for dental restoration and jewelry items.

Another object of the invention is to provide a dental alloy composition having the strength properties required by ANSI/ADA 5.

A further object is to provide a dental alloy composition having little or no gold, thus limiting the intrinsic cost of the alloy.

A further object is to provide a dental alloy composition having the necessary tarnish and corrosion resistance needed for dental use.

A further object is to provide a dental alloy composition having sufficient solderability for normal soldering operations used in dental and jewelry fabrications.

The present invention provides an alloy composition for dental restorations or jewelry castings consisting essentially of about 9.0%-58.0% palladium and 5.0%-42.0% indium combined with one or more other constituents in the following ranges of percentages by weight:

| CONSTITUENTS | PROPORTIONAL RANGE IN % |
|---|---|
| Silver | 10-50.0 |
| Gold | 0-30.0 |
| Copper | 0-45.0 |
| Niobium | 0-7.0 |
| Platinum | 0-4.5 |
| Zinc | 0-5.0 |
| Tungsten | 0-3.0 |
| Tin | 0-2.0 |
| Germanium | 0-1.0 |
| Tantalum | 0-1.0 |
| Silicon | 0-0.75 |
| Phosphorus | 0-0.75 |

-continued

| CONSTITUENTS | PROPORTIONAL RANGE IN % |
|---|---|
| Titanium | 0–0.5 |
| Iridium | 0–0.5 |
| Rhenium | 0–0.5 |
| Boron | 0–0.1 |
| Lithium | 0–0.025 |

Although the above-described ranges encompass the dental alloys of this invention, not all alloys possible (within the given ranges) are contemplated. In specific a crucial ingredient (for the desired color purposes) is the colored intermetallic compound of Palladium (Pd) and Indium (In), which intermetallic compound generally corresponds to PdIn and the combination of this intermetallic compound with the intermetallic compound $InPd_2$ (which is not colored). Reference is made to Elliott, Binary Phase Diagrams, reproduce and expanded in ASM Binary Alloy Phase Diagrams. (Hereinafter cited as "Elliott Binary Phase Diagrams".)

Thus, in detail, the dental alloys of this invention comprise by weight thereof roughly 15% to 85% of a colored intermetallic compound of Pd and In and at least about 10% silver. The balance, amounting to roughly 5–75% of the dental alloy, may be one or more of the minor (less than 10%) proportioned constituents listed above, including copper, gold even more silver and as desired either Pd or In. However, the additional Pd or In employed must be in a proportion consistent with the presence of the colored intermetallic compound of Pd and In in the dental alloy.

Preferred is the presence of at least 21% by weight of the colored intermetallic compound of Pd and In in the dental alloy.

DISCUSSION OF THE INVENTION

Both Palladium and Indium are known in the art as components in dental alloy compositions being particularly suggested for dental alloys that are low in gold content (see for Example Great Britain No. 2,106,137A). Palladium is an economically priced platinum group metal which imparts tarnish and corrosion resistance to the alloy. Indium also contributes to the tarnish and corrosion resistance of the alloy.

It has been discovered that the two gray (sometimes called white) metallic elements, palladium and indium, when combined in certain ratios, produce a series of binary alloys exhibiting an aesthetically pleasing yellow color. This phenomenon is totally unexpected, since previous yellow dental alloys had depended upon the presence of substantial amounts of gold or copper to provide the basis of their yellow hue.

More specifically, the color phenomenon is related to certain intermetallic compounds formed by the combination of palladium and indium. An intermetallic compound is a compound formed of two or more metals which has a distinctive crystallographic structure and a definite range of composition. These compounds differ from chemical compounds, such as salt (NaCl), because their compositions are not fixed, but may vary within moderate limits. (See Elliott, Binary Phase Diagrams.) There are 5 intermetallic compounds shown; $In_3Pd$, $In_3Pd_2$, InPd, $InPd_2$ and $InPd_3$.

The intermetallic compound that produces the color is the PdIn intermetallic compound. This compound, with a theoretical composition of 50 atomic% In and 50 atomic% Pd (52 wt% In, 48 wt% Pd), is copper colored; a relatively large component of red color with a smaller component of yellow color. The intermetallic compound, InPd, has a wider composition range than might be expected; from 46 to 58 wt% Pd, balance In. Within these compositional limits, alloys varying from copper colored to gold colored can be found. But, even though gold colored alloys may be found in the simple binary alloys of palladium and indium, they are not useful alloys because they are very brittle and they fracture in the mold when cast by the 'lost wax' procedure commonly used in dental and jewelry casting.

While the color of the InPd compound is very similar to that of copper, its reaction to dilution is quite different than that experienced with copper itself. It was very surprising to find that the addition of indium to copper colored InPd resulted in the loss of yellow, producing (in the $InPd+In_3Pd_2$ field of the binary phase diagram) a lavender colored alloy. With further addition of indium, all color is lost.

The only color change that might be predicted by a knowledge of copper, was dilution by further addition of palladium. In the InPd field of the binary phase diagram, addition of palladium results in a gradual loss of red; a true gold color is produced; primarily yellow hue; with some red. In the $InPd+InPd_2$ field, addition of more palladium results in dilution of the gold color. The $InPd_2$ and higher palladium phases are gray.

Entirely unexpected was the fact that addition of other elements to the colored indium-palladium binary did not affect the color until considerable addition was made, and then the effect was simply a dilution of the color towards gray/white. Surprisingly, addition of neither gold nor copper enhanced the color of the binary alloy; gold diluted the color toward gray/white; copper diluted it toward pink/gray.

The colored phases of the palladium-indium binary system have been found to be hard and brittle and to possess little strength. Such properties would cause the resulting alloys to be unsuitable for use in dentistry and perhaps jewelry as well because of the difficulty of casting and/or cold working the alloy. Accordingly, a necessary feature of this invention is to incorporate the intermetallic compound into a more ductile matrix so that it will be suitable for use as a dental or jewelry casting alloy, and yet still allow a yellow color to be generated in the resultant alloy by the PdIn intermetallic compound. In particular at least 10% by weight of silver is present in the dental alloys of this invention.

The role of the alloying element(s) is believed to be as follows. While not an element in the chemical sense of the word, PdIn acts as an independent element of the alloy composition. It is important as it furnishes the color of the alloy. Its less desirable properties, such as brittleness and low strength, must be overcome by the addition of other metallic elements so as to generate a dental alloy. Silver is believed to be the most convenient and advantageous alloying constituent.

Silver, copper and/or gold contribute to the ductility and castability of the alloy, so that the alloys produced can be readily cast into the intricate shapes required for dental restorations and jewelry. Thus, additions of up to 86 wt% of a combination of these three elements may be made to provide a sufficiently ductile matrix. However, in order to insure a desirable yellow to gold color, the indium-palladium content must still exceed approximately 15 wt% of the alloy while maxima for silver, copper and gold are 50, 45 and 30 wt% respectively. As has already been indicated, preferred dental alloys contain at least 21% by weight of the colored intermetallic compound of palladium and indium, and, as has been indicated, at least 10% silver, preferably at least 15% silver.

In order to obtain the desired color result, the palladium and indium must be present in a ratio to produce at least some of the palladium indium intermetallic compound. This ratio in the palladium/indium binary, ranges from 0.85–1.95 to 1.0 by weight. More preferably, 0.9–1.9 to 1.0; the color being attributed to the colored intermetallic compound of palladium and indium. It has been discovered that in the presence of silver, the upper limit increases until at a silver content above 30%, the Pd/In ratio can be increased to as hight as 4.0 to 1.0 and still maintain the desired color of the resulting alloy. This is believed to be due to the incorporation of silver into the colored palladium-indium intermetallic compound, thus producing a three-element intermetallic compound which also possesses a yellow color. Within the content of this invention gold, as such, is of yellow color i.e. its dominant color is yellow. Some of the dental alloys of this invention might be described as having a pale gold color (see Example 1 hereinafter).

Provided above is a very large degree of variation in permissible alloy constituents and properties. On the whole, this invention has been described in an expansive sense with the intention to provide for maximum flexibility to efforts by the art to improve upon the best mode dental alloys hereinafter exemplified. It should be appreciated that actual practice of this invention may not be coextensive with the entire above-given ranges of alloy constituents and proportions. The alloy must be colored, i.e., yellow, and must be characterizable as a dental alloy. It may well be possible to generate dental alloys that fall within the above-described proportional and compositional ranges, yet fail to be colored (i.e., yellow), and, of course, such alloys fall outside the purview of this invention. It may well be possible to generate attractive looking alloy compositions that fail to meet ANSI/ADA standards, failing then to be dental alloys and falling outside the purview of this invention.

PREFERRED MODES OF THE INVENTION

Preferred dental alloy compositions contain at least about 15% by weight of silver, i.e., 15–50%, and also at least about 21% by weight of the colored intermetallic compound of Pd and In.

For economic reasons, it may be preferable to increase the indium content of the alloy composition to 21% or higher. At levels below 21% relatively high amounts of gold (20–30%) and/or silver (15–40%) must be present in the alloy.

The minor proportioned components listed above may be incorporated into the dental alloy composition to perform various functions not uncommon in dental and/or jewelry alloys. Those which have proved useful in this alloy system as deoxidizers or oxygen scavengers for removing unwanted oxides and/or oxygen during the alloying and subsequent remelting procedures include silicon, lithium, zinc, boron, and/or tin. Even indium acts as an oxygen scavenger but the more active elements need to be used to avoid depleting the indium.

It is preferable to maintain an average grain size of less than 50μ in a casting alloy because as the molten alloy solidifies the last areas to freeze are the grain to grain interfaces (grain boundaries). Impurities and other materials not soluble in the matrix are rejected from the solidifying area to these interfaces. The smaller the grains, the larger the interface area available over which to spread these impurities, thus diminishing the likelihood of a buildup of impurities sufficient to cause a weakness or fault in the finished casting. Rhenium, ruthenium, germanium, and/or lithium have been shown to be useful in reducing and/or maintaining small grain sizes.

Rhenium, ruthenium, silicon, boron and lithium are normally used in trace amounts generally not exceeding 0.5% by weight of the alloy. However, as is well known in the art, these elements may be present in higher amounts without any detrimental effect on the instant alloy system. For example rhenium, ruthenium and lithium may be used in amounts up to 1%, while boron and silicon may each be present in an amount up to 5%. Such metals should not, of course, be present in amounts sufficient to decolor the alloy.

While certain elements are included in several or the foregoing categories, the extent of use of each element may be limited by its effect on other requirements. For example, while gold provides ductility, and tarnish and corrosion resistance, it must be maintained at less than 30% by weight or the resultant alloy will be white, not yellow. Silver provides ductility and improves castability but must be maintained at less that 50% by weight or the resultant alloy begins to lose its yellow color. Copper also provides ductility but must be held to less than 45% or the resultant alloy loses yellow color although the red remains at higher copper levels.

Additionally, there are many elements which can be added to increase the strength or hardness of the resultant alloys. Such elements include tin, boron, phosphorus, silicon, niobium, platinum, indium, tantalum, titanium and tungsten.

The alloys of the present invention are illustrated further by the Examples set forth below. Hardness was measured for selected alloys and serves as a guide in ascertaining usability of the alloy for dental purposes. In particular, the Vickers Hardness data was taken with a standard diamond pyramid indenter under a 1 kilogram load (HV1). Since hardness is not comparable from one alloy system to another, some other mechanical property must be employed to compare different systems. In the present case, the 0.1% offset yield strength was measured for selected alloys by standard methods. For the remaining Examples, however, hardness is used as an indicator since it involves a test which consumes less time and effort as compared to yield strength testing and since in the same alloy system yield strength is proportional to hardness. The Vickers Hardness shown in the Examples is for a cast alloy of this invention, and was measured in accordance with the American Dental Association Specification #5 for dental castings. The minimum ADA Vickers Hardness is 120 and strength 29,000 psi for Type III alloys.

All of the alloys of the present invention were observed to have sufficient fluidity in the molten state to fill an intricate mold thereby possessing the degree of castability required for dental alloys and the like. Further, all of the alloys disclosed herein are made according to standard induction melting procedures.

EXAMPLE 1

| CONSTITUENT | COMPOSITION IN WEIGHT % |
|---|---|
| Palladium | 20.0 |
| Indium | 16.0 |

-continued

EXAMPLE 1

| CONSTITUENT | COMPOSITION IN WEIGHT % |
|---|---|
| Silver | 40.0 |
| Gold | 20.0 |
| Zinc | 4.0 |

Strength: (0.1% offset yield)—33,700 psi
Color: Pale Gold
Pd/In: (1.25)

EXAMPLE 2

| CONSTITUENT | COMPOSITION IN WEIGHT % |
|---|---|
| Palladium | 40.0 |
| Indium | 16.0 |
| Silver | 20.0 |
| Gold | 20.0 |
| Zinc | 4.0 |

Strength: (0.1% offset yield)—62,100 psi
Color: Very Pale
Pd/In: (2.5)

EXAMPLE 3

| CONSTITUENT | COMPOSITION IN WEIGHT % |
|---|---|
| Palladium | 30.0 |
| Indium | 16.0 |
| Silver | 30.0 |
| Gold | 20.0 |
| Zinc | 4.0 |

Strength: (0.1% offset yield)—34,000 psi
Color: Very Pale
Pd/In: (1.9)

EXAMPLE 4

| CONSTITUENT | COMPOSITION IN WEIGHT % |
|---|---|
| Palladium | 25.0 |
| Indium | 16.0 |
| Silver | 25.0 |
| Gold | 30.0 |
| Zinc | 4.0 |

Strength: (0.1% offset yield)—36,500 psi
Color: Pale Gold
Pd/In: (1.6)

EXAMPLE 5

| CONSTITUENT | COMPOSITION IN WEIGHT % |
|---|---|
| Palladium | 46.275 |
| Indium | 33.2 |
| Silver | 15.0 |
| Copper | 5.0 |
| Zinc | 0.5 |
| Lithium | 0.025 |

Vickers Hardness (HV1)—253
Pd/In: 1.4

EXAMPLE 6

| CONSTITUENT | COMPOSITION IN WEIGHT % |
|---|---|
| Palladium | 46.275 |
| Indium | 33.2 |
| Silver | 15.0 |
| Copper | 4.9 |
| Zinc | 0.5 |
| Lithium | 0.025 |
| Boron | 0.1 |

Vickers Hardness (HV1)—269
Pd/In: 1.4

EXAMPLE 7

| CONSTITUENT | COMPOSITION IN WEIGHT % |
|---|---|
| Palladium | 46.275 |
| Indium | 33.2 |
| Silver | 15.0 |
| Copper | 4.25 |
| Zinc | 0.5 |
| Lithium | 0.025 |
| Phosphorus | 0.75 |

Vickers Hardness (HV1)—284
Pd/In: 1.4

EXAMPLE 8

| CONSTITUENT | COMPOSITION IN WEIGHT % |
|---|---|
| Palladium | 46.275 |
| Indium | 33.2 |
| Silver | 15.0 |
| Copper | 4.25 |
| Zinc | 0.5 |
| Lithium | 0.025 |
| Silicon | 0.75 |

Vickers Hardness (HV1)—328
Color: Pink-Gold
Pd/In: 1.4

EXAMPLE 9

| CONSTITUENT | COMPOSITION WEIGHT % |
|---|---|
| Palladium | 48.775 |
| Indium | 35.0 |
| Silver | 15.0 |
| Zinc | 0.5 |
| Lithium | 0.025 |
| Germanium | 0.7 |

Vickers Hardness (HV1)—225
Pd/In: 1.4

EXAMPLE 10

| CONSTITUENT | COMPOSITION IN WEIGHT % |
|---|---|
| Palladium | 48.575 |
| Indium | 34.9 |
| Silver | 15.0 |
| Zinc | 0.5 |
| Lithium | 0.025 |
| Niobium | 1.0 |

Vickers Hardness (HV1)—222

Pd/In: 1.4

EXAMPLE 11

| CONSTITUENT | COMPOSITION IN WEIGHT % |
|---|---|
| Palladium | 45.575 |
| Indium | 31.4 |
| Silver | 15.0 |
| Zinc | 0.5 |
| Lithium | 0.025 |
| Germanium | 0.5 |
| Niobium | 7.0 |

Vickers Hardness (HV1)—295
Color: Pale Yellow
Pd/In: 1.45

EXAMPLE 12

| CONSTITUENT | COMPOSITION IN WEIGHT % |
|---|---|
| Palladium | 57.675 |
| Indium | 41.8 |
| Zinc | 0.5 |
| Lithium | 0.025 |

Vickers Hardness (HV1)—311
Strength: (Too brittle to permit measurement)
Pd/In: 1.4

EXAMPLE 13

| CONSTITUENT | COMPOSITION IN WEIGHT % |
|---|---|
| Palladium | 42.075 |
| Indium | 31.4 |
| Silver | 25.0 |
| Zinc | 0.5 |
| Lithium | 0.025 |
| Platinum - (10% Iridium) | 1.0 |

Vickers Hardness (HV1)—177
Strength: (0.1% offset yield)—36,400 psi
Pd/In: 1.3

EXAMPLE 14

| CONSTITUENT | COMPOSITION IN WEIGHT % |
|---|---|
| Palladium | 42.775 |
| Indium | 30.7 |
| Silver | 25.0 |
| Germanium | 1.0 |
| Zinc | 0.5 |
| Lithium | 0.025 |

Vickers Hardness (HV1)—215
Strength: (0.1% offset yield)—47,500 psi
Color: Pale Gold
Pd/In: 1.4

EXAMPLE 15

| CONSTITUENT | COMPOSITION IN WEIGHT % |
|---|---|
| Palladium | 14.5 |
| Indium | 11.0 |
| Silver | 40.0 |
| Gold | 20.0 |
| Copper | 10.0 |
| Tin | 2.0 |
| Zinc | 2.0 |
| Rhenium | 0.25 |

EXAMPLE 15-continued

| CONSTITUENT | COMPOSITION IN WEIGHT % |
|---|---|
| Ruthenium | 0.25 |

Vickers Hardness (HV1)—195
Strength: (0.1% offset yield)—51,000 psi
Color: Yellow
Pd/In: 1.3

EXAMPLE 16

| CONSTITUENT | COMPOSITION IN WEIGHT % |
|---|---|
| Palladium | 19.5 |
| Indium | 16.0 |
| Silver | 40.0 |
| Gold | 20.0 |
| Tin | 2.0 |
| Zinc | 2.0 |
| Rhenium | 0.5 |
| Ruthenium | 0.5 |

Vickers Hardness (HV1)—165
Strength: (0.1% offset yield)—33,000 psi
Color: Pale Gold
Pd/In: 1.2

EXAMPLE 17

| CONSTITUENT | COMPOSITION IN WEIGHT % |
|---|---|
| Palladium | 9.0 |
| Indium | 6.5 |
| Silver | 40.0 |
| Gold | 25.0 |
| Copper | 15.0 |
| Zinc | 2.0 |
| Tin | 2.0 |
| Rhenium | 0.25 |
| Ruthenium | 0.25 |

Vickers Hardness (HV1)—185
Color: Pale Gold
Pd/In: 1.4

EXAMPLE 18

| CONSTITUENT | COMPOSITION IN WEIGHT % |
|---|---|
| Palladium | 9.0 |
| Indium | 6.5 |
| Silver | 40.0 |
| Gold | 27.0 |
| Copper | 17.0 |
| Rhenium | 0.25 |
| Ruthenium | 0.25 |

Vickers Hardness (HV1)—225
Color: Pale Gold
Pd/In: 1.4

EXAMPLE 19

| CONSTITUENT | COMPOSITION IN WEIGHT % |
|---|---|
| Palladium | 17.7 |
| Indium | 12.8 |
| Silver | 30.0 |
| Gold | 25.0 |
| Copper | 10.0 |
| Zinc | 2.0 |
| Tin | 2.0 |
| Rhenium | 0.25 |
| Ruthenium | 0.25 |

Color: Yellow
Pd/In: 1.4

EXAMPLE 20

| CONSTITUENT | COMPOSITION IN WEIGHT % |
|---|---|
| Palladium | 23.5 |
| Indium | 17.0 |
| Silver | 20.0 |
| Gold | 25.0 |
| Copper | 10.0 |
| Zinc | 2.0 |
| Tin | 2.0 |
| Rhenium | 0.25 |
| Ruthenium | 0.25 |

Color: Yellow
Pd/In: 1.4

EXAMPLE 21

| CONSTITUENT | COMPOSITION IN WEIGHT % |
|---|---|
| Palladium | 29.3 |
| Indium | 21.2 |
| Silver | 10.0 |
| Gold | 25.0 |
| Copper | 10.0 |
| Zinc | 2.0 |
| Tin | 2.0 |
| Rhenium | 0.25 |
| Ruthenium | 0.25 |

Color: Yellow
Pd/In: 1.4

EXAMPLE 22

| CONSTITUENT | COMPOSITION IN WEIGHT % |
|---|---|
| Palladium | 35.1 |
| Indium | 25.4 |
| Gold | 25.0 |
| Copper | 10.0 |
| Zinc | 2.0 |
| Tin | 2.0 |
| Rhenium | 0.25 |
| Ruthenium | 0.25 |

Color: Yellow
Pd/In: 1.4

EXAMPLE 23

| CONSTITUENT | COMPOSITION IN WEIGHT % |
|---|---|
| Palladium | 14.5 |
| Indium | 11.0 |
| Silver | 40.0 |
| Gold | 22.0 |
| Copper | 12.0 |
| Rhenium | 0:25 |
| Ruthenium | 0.25 |

Vickers Hardness (HV1)—180
Color: Pale Gold
Pd/In: 1.3

EXAMPLE 24

| CONSTITUENT | COMPOSITION IN WEIGHT % |
|---|---|
| Palladium | 14.5 |
| Indium | 11.0 |
| Silver | 40.0 |
| Gold | 22.0 |
| Copper | 12.0 |
| Zinc | 2.0 |
| Rhenium | 0.25 |

EXAMPLE 24-continued

| CONSTITUENT | COMPOSITION IN WEIGHT % |
|---|---|
| Ruthenium | 0.25 |

Vickers Hardness (HV1)—215
Color: Pale Gold
Pd/In: 1.3

EXAMPLE 25

| CONSTITUENT | COMPOSITION IN WEIGHT % |
|---|---|
| Palladium | 20.0 |
| Indium | 16.0 |
| Silver | 40.0 |
| Gold | 20.0 |
| Zinc | 4.0 |

Strength: (0.1% offset yield)—33,500 psi)
Color: Pale Gold
Pd/In: 1.25

EXAMPLE 26

| CONSTITUENT | COMPOSITION IN WEIGHT % |
|---|---|
| Palladium | 40.975 |
| Indium | 30.5 |
| Silver | 25.0 |
| Platinum | 2.7 |
| Iridium | 0.3 |
| Zinc | 0.5 |
| Lithium | 0.025 |

Vickers Hardness (HV1)—167
Strength: (0.1% offset yield)—28,400 psi)
Pd/In: 1.3

EXAMPLE 27

| CONSTITUENT | COMPOSITION IN WEIGHT % |
|---|---|
| Palladium | 39.775 |
| Indium | 29.7 |
| Silver | 25.0 |
| Platinum | 4.5 |
| Iridium | 0.5 |
| Zinc | 0.5 |
| Lithium | 0.025 |

Vickers Hardness (HV1)—172
Strength: (0.1% offset yield)—33,200 psi)
Pd/In: 1.3

EXAMPLE 28

| CONSTITUENT | COMPOSITION IN WEIGHT % |
|---|---|
| Palladium | 42.375 |
| Indium | 31.6 |
| Silver | 25.0 |
| Tantalum | 0.5 |
| Zinc | 0.5 |
| Lithium | 0.025 |

Vickers Hardness (HV1)—188
Pd/In: 1.3

EXAMPLE 29

| CONSTITUENT | COMPOSITION IN WEIGHT % |
|---|---|
| Palladium | 42.075 |
| Indium | 31.4 |

-continued

EXAMPLE 29

| CONSTITUENT | COMPOSITION IN WEIGHT % |
|---|---|
| Silver | 25.0 |
| Tantalum | 1.0 |
| Zinc | 0.5 |
| Lithium | 0.025 |

Vickers Hardness (HV1)—208
Pd/In: 1.3

EXAMPLE 30

| CONSTITUENT | COMPOSITION IN WEIGHT % |
|---|---|
| Palladium | 42.375 |
| Indium | 31.6 |
| Silver | 25.0 |
| Titanium | 0.5 |
| Zinc | 0.5 |
| Lithium | 0.025 |

Vickers Hardness (HV1)—194
Pd/In: 1.3

EXAMPLE 31

| CONSTITUENT | COMPOSITION IN WEIGHT % |
|---|---|
| Palladium | 42.075 |
| Indium | 31.4 |
| Silver | 25.0 |
| Tungsten | 1.0 |
| Zinc | 0.5 |
| Lithium | 0.025 |

Vickers Hardness (HV1)—195
Pd/In: 1.3

EXAMPLE 32

| CONSTITUENT | COMPOSITION IN WEIGHT % |
|---|---|
| Palladium | 40.525 |
| Indium | 30.5 |
| Silver | 25.0 |
| Tungsten | 3.0 |
| Zinc | 0.5 |
| Lithium | 0.025 |

Vickers Hardness (HV1)—183
Pd/In: 1.3

EXAMPLE 33

| CONSTITUENT | COMPOSITION IN WEIGHT % | | | |
|---|---|---|---|---|
| | A | B | C | D |
| Palladium | 35.75 | 33.0 | 30.25 | 27.5 |
| Indium | 29.25 | 27.0 | 24.75 | 22.5 |
| Copper | 35.00 | 40.0 | 45.0 | 50.0 |
| Color: | pink/ gold | pink/ gold | light pink/ gold | light pink |
| Pd/In: | 0.9 | 1.22 | 1.22 | 1.22 |

EXAMPLE 34

| CONSTITUENT | COMPOSITION IN WEIGHT % |
|---|---|
| Palladium | 10.0 |
| Indium | 5.0 |
| Silver | 46.0 |
| Gold | 25.0 |
| Copper | 10.0 |
| Tin | 2.0 |
| Zinc | 2.0 |

Color: Pale Gold
Pd/In: 2.0

EXAMPLE 35

| CONSTITUENT | COMPOSITION IN WEIGHT % |
|---|---|
| Palladium | 15.0 |
| Indium | 5.0 |
| Silver | 41.0 |
| Gold | 25.0 |
| Copper | 10.0 |
| Tin | 2.0 |
| Zinc | 2.0 |

Color: Pale Gold
Pd/In: 3.0

EXAMPLE 36

| CONSTITUENT | COMPOSITION IN WEIGHT % |
|---|---|
| Palladium | 20.0 |
| Indium | 5.0 |
| Silver | 36.0 |
| Gold | 25.0 |
| Copper | 10.0 |
| Tin | 2.0 |
| Zinc | 2.0 |

Color: Pale Gold
Pd/In: 4.0

EXAMPLE 37

| CONSTITUENT | COMPOSITION IN WEIGHT % |
|---|---|
| Palladium | 25.0 |
| Indium | 5.0 |
| Silver | 31.0 |
| Gold | 25.0 |
| Copper | 10.0 |
| Tin | 2.0 |
| Zinc | 2.0 |

Color: White
Pd/In: 5.0

EXAMPLE 38

| | A | B | C | D | E | F | G | H | I |
|---|---|---|---|---|---|---|---|---|---|
| Palladium | 62 | 61.5 | 61 | 60.5 | 60 | 59.5 | 59 | 58.5 | 58 |
| Indium | 38 | 38.5 | 39 | 39.5 | 40 | 40.5 | 41 | 41.5 | 42 |
| (Pd/In) | (1.6) | | | (1.5) | | | (1.4) | | |
| Color | → Increasing intensity of yellow color → | | | | | | | | |

EXAMPLE 39

| | J | K | L | M | N | O | P | Q | R | S | T |
|---|---|---|---|---|---|---|---|---|---|---|---|
| Palladium | 60 | 58 | 56 | 54 | 52 | 50 | 48 | 46 | 44 | 42 | 40 |
| Indium | 40 | 42 | 44 | 46 | 48 | 50 | 52 | 54 | 56 | 58 | 60 |
| (Pd/In) | (1.5) | (1.4) | (1.3) | (1.2) | (1.1) | (1.0) | (0.9) | (0.9) | (0.8) | (0.7) | (0.7) |
| Color | Yellow | Yellow | Yellow | Lt. Yellow | Pinkish Yellow | → | Lt. Pinkish Yellow | → | Very Slightly Pink | → | Gray |

EXAMPLE 40

| | U | V | W | X |
|---|---|---|---|---|
| Palladium | 58 | 62 | 66 | 70 |
| Indium | 42 | 38 | 34 | 30 |
| (Pd/In) | (1.4) | (1.6) | (1.9) | (2.3) |
| Color | Best Yellow | Good Yellow | Gray | Gray |

EXAMPLE 41

| | AA | BB | CC |
|---|---|---|---|
| Palladium | 30.25 | 27.5 | 24.75 |
| Indium | 24.75 | 22.5 | 20.25 |
| Silver | 45.0 | 50.0 | 55.0 |
| (Pd/In) | 1.22 | 1.22 | 1.22 |
| Color | Best | ← Intensity → | Least |

EXAMPLE 42

| | FF | GG | HH | II | JJ | KK |
|---|---|---|---|---|---|---|
| Palladium | 58.0 | 58.0 | 58.0 | 59.75 | 61.5 | 59.75 |
| Indium | 41.5 | 39.75 | 38.0 | 38.0 | 38.0 | 39.75 |
| Gold | 0.5 | 2.25 | 4.0 | 2.25 | 0.5 | 0.5 |
| (Pd/In) | (1.4) | (1.5) | (1.5) | (1.6) | (1.6) | (1.5) |
| Color | Best | Lighter | → | → | → | → |

EXAMPLE 43

| | LL | MM | NN | PP |
|---|---|---|---|---|
| Palladium | 52.2 | 46.4 | 40.6 | 34.8 |
| Indium | 37.8 | 33.6 | 29.4 | 25.2 |
| Gold | 10.0 | 20.0 | 30.0 | 40.0 |
| (Pd/In) | (1.4) | (1.4) | (1.4) | (1.4) |
| Color | Yellow | Paler Yellow | Very Pale Yellow | Gray |

Examples 38–40 demonstrate the critical effect of the Pd/In ratio on the color. Example 38 shows the increasing intensity of the yellow color as the Pd/In ratio moves into the preferred range. From Example 39 it can be seen that at a ratio below 0.9 the color deteriorates from an acceptable "pinkish yellow" to an unsuitable "slightly pink". Examples 40 and 41 illustrate that at ratios higher than 1.7, in the absence of silver, the resulting alloy exhibits an unacceptable gray color. However, Examples 34–37, further demonstrate that when high levels of silver are present (i.e. between 30–46%), a yellow color can be maintained in alloys with a Pd/In ratio as high as 4.0 to 1.0.

Example 41 illustrates the effect on color of added silver in varying proportions. The addition produces a simple dilution of color until at 55%, the alloy can no longer be called yellow. This result is unexpected since in gold alloys, silver enhances the gold color until at higher content, a greenish color results.

Examples 42 and 43 illustrate the effect on color of varying the concentration of gold present in the alloy composition. From Example 43 is can be seen that additions of 10%, 20% and 30% gold produce alloys with increasingly paler yellows until a gray color is produced at a level above 30%. This result is totally unexpected, since gold itself possesses a yellow color and is widely known to impart its yellow color to conventional dental and jewelry alloys.

Example 33 illustrates the effect on color of varying the concentration of copper present in the alloy. 30%, 35% and 40% copper results in decreasing pink-gold color until at 45%, the yellow component of color has become a pink-gray color. This is also unexpected, since copper normally imparts a gold to rose gold color in previously known alloys.

When used in making dental restorations and the like, the alloys of the present invention are cast to the desired shape by standard casting procedures well-known in the art. The alloys are heated to above the approximate melting temperature until they pool in molten form and then cast using a standard dental casting machine. These alloys have sufficient fluidity when melted for casting to fill an intricate mold completely.

It is therefore apparent that the alloy system of the present invention accomplishes its intended objects. While this invention has been described in detail, this is for the purpose of illustration, not limitation.

What is claimed is:

1. A yellow dental alloy comprising a intermetallic mixture of Pd and In as about 15 wt% to 85 wt% of the dental alloy and from about 15 wt% to 85 wt% of an alloying metal constituent including silver as at least 15 wt% of the dental alloy and being selected from the group consisting of silver, gold, copper and mixture thereof, the maximum content in the dental alloy of silver being 50 wt% of gold being 20 wt%, of copper being 45 wt%, there being at least 9% Pd and 5% In in said yellow dental alloy and the ratio by weight of palladium to indium being between about 0.9–4.0.

2. A yellow dental alloy as in claim 1 further comprising having therein at least 21 wt% of the colored intermetallic mixture of Pd and In and at least 15 wt % of silver.

3. A yellow dental alloy as in claim 1 further comprising an indium content of at least 21 wt%.

4. A yellow dental alloy as in claim 1 further comprising one or more of the following in up to the wt% proportion listed below.

| CONSTITUENTS | PROPORTIONAL RANGE IN WT % |
|---|---|
| Niobium | 0–7.0 |
| Platinum | 0–4.5 |
| Zinc | 0–4.0 |
| Tungsten | 0–3.0 |

-continued

| CONSTITUENTS | PROPORTIONAL RANGE IN WT % |
|---|---|
| Tin | 0–2.0 |
| Germanium | 0–1.0 |
| Tantalum | 0–1.0 |
| Silicon | 0–0.75 |
| Phosphorus | 0–0.75 |
| Titanium | 0–0.5 |
| Iridium | 0–0.5 |
| Rhenium | 0–0.5 |
| Boron | 0–0.1 |
| Lithium | 0–0.025 |

5. An alloy according to claim 1 wherein the ratio by weight of palladium to indium is between about 0.9–1.7.

6. A cast dental restoration made from an alloy according to claim 1.

7. A cast dental restoration made from an alloy according to claim 1 having at least one layer of acrylic resin affixed on the surface thereof.

8. A yellow palladium/indium based alloy consisting essentially of the following constituents in the indicated percentages by weight: palladium 42.775%, indium 30.7%, silver 25.0%, germanium 1.0%, zinc 0.5% and lithium 0.025%.

9. A dental restoration made form an alloy in accord with claim 8.

10. A yellow palladium/indium/silver based dental alloy consisting essentially of the following constituents in the indicated percentages by weight: palladium 14.5%, indium 11.0%, silver 40.0%, gold 20.0%, copper 10.0%, tin 2.0%, zinc 2.0%, rhenium 0.25% and ruthenium 0.25%.

11. A dental restoration made from an alloy in accord with claim 10.

12. A yellow palladium/indium/silver based dental alloy consisting essentially of the following constituents in the indicated percentages by weight: palladium 19.5%, indium 16.0%, silver 40.0%, gold 20.0%, tin 2.0%, zinc 2.0%, rhenium 0.5% and ruthenium 0.5%.

13. A dental restoration made from an alloy in accordance with claim 12.

* * * * *